US006543640B2

(12) United States Patent
Russo

(10) Patent No.: US 6,543,640 B2
(45) Date of Patent: Apr. 8, 2003

(54) CLEANING DEVICE AND METHOD

(75) Inventor: Peter B. Russo, Califon, NJ (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/140,700

(22) Filed: Aug. 26, 1998

(65) Prior Publication Data

US 2001/0038016 A1 Nov. 8, 2001

(51) Int. Cl.[7] ..... B65H 1/00; B65D 83/00
(52) U.S. Cl. ..... 221/34; 221/64
(58) Field of Search ..... 221/34, 33, 63, 221/64; 206/389, 401, 406

(56) References Cited

U.S. PATENT DOCUMENTS

| | | | | |
|---|---|---|---|---|
| 4,002,264 A | | 1/1977 | Marchesani | |
| 4,185,754 A | * | 1/1980 | Julius | 221/63 |
| 4,570,820 A | * | 2/1986 | Murphy | 221/63 X |
| 4,783,129 A | * | 11/1988 | Jacobson | 312/1 |
| 5,149,389 A | * | 9/1992 | Heyes et al. | 156/272.4 |
| 5,467,893 A | * | 11/1995 | Landis, II et al. | 221/34 X |
| 5,595,786 A | | 1/1997 | McBride, Jr. et al. | |
| 5,688,394 A | | 11/1997 | McBride, Jr. et al. | |
| 5,896,627 A | * | 4/1999 | Cappel et al. | 24/400 |
| 5,938,013 A | * | 8/1999 | Palumbo et al. | 221/45 X |

FOREIGN PATENT DOCUMENTS

| | | |
|---|---|---|
| EP | 0 364 896 A1 | 10/1989 |
| EP | 0 364 896 1 A | 10/1989 |

OTHER PUBLICATIONS

Advertisement from "Clean Rooms" Magazine, Apr. 1993 (copy of cover and p. 16) and brochure, all describing "PROSAT" clean room wipers.
Advertising literature for "WetTask" refillable wiping system (5 pages) 1994.

* cited by examiner

*Primary Examiner*—Joseph E. Valenza
*Assistant Examiner*—Gene O. Crawford
(74) *Attorney, Agent, or Firm*—Kramer Levin Naftalis & Frankel LLP; Gregor N. Neff

(57) ABSTRACT

Wipers in roll form or separate sheets are stored in a plastic bag. A reclosable outlet is provided for the bag. In use with roll-form wipers, a restricted outlet is provided so as to provide resistance to the withdrawal of a strip of wipers from the bag, and allow them to be torn off along perforation lines delineating the wipers from one another. Preferably, the wiper material has a cleaning liquid absorbed in it. The bag material is a laminate comprising aluminum foil sandwiched between layers of polyester with an inner layer of polyethylene. This material is highly resistant to attack by aggressive solvents. In use with separate wipers, the bag has a slide-fastener closure which gives a wide outlet opening and adhesive-free closing.

18 Claims, 4 Drawing Sheets

CLEANING DEVICE AND METHOD

BACKGROUND OF THE INVENTION

This invention relates to dispensers and containers for cleaning materials, particularly for wipers for use in cleaning surfaces, and to methods of using such wipers.

A known type of wiping material is supplied in elongated strips wound into rolls. Individual sheets of wiping material are delineated from one another in the strip by lines of weakness such as perforation lines. The wipers are torn from the strip along the perforation lines.

Such wipers typically are dispensed from a container such as a plastic tub with a restricted outlet opening through which the end of the strip can be pulled. The restricted outlet opening provides sufficient resistance to the movement of the material through the opening so that the end wiper can be torn loose from the remainder of the strip by pulling on it with one hand.

The roll of wipers in the tub is pre-moistened either by the manufacturer before being placed in the tub, or by the user. Typically, the tub and the roll of wipers are sold separately and combined by the user, who pours liquid solvent into the tub, where it is absorbed by the roll of cleaning material.

In such prior devices in which the roll is presaturated by the manufacturer, presaturated replacement rolls of wiping material are supplied in separate individual sealed foil pouches. When the roll supplied in the tub by the manufacturer is used up, the tub is opened up, the sealed package holding a replacement roll is opened, the roll is inserted into the tub, and the end of the wiper strip is threaded through the restricted outlet opening. Thus, the tub is reused a number of times.

There are several problems with such prior dispensers. One problem is that the tubs are relatively large and expensive to make. Another is that the material of which they are made often deteriorates when some of the more aggressive cleaning solvents are used. For example, solvents such as methyl propyl ketone ("MPK") methyl ethyl ketone ("MEK"), acetone, napthas, etc. attack and greatly weaken or destroy the plastic material of the tubs. Thus, the tubs well might not have a very long shelf life, and might not be re-useable, under certain circumstances.

Other problems with such prior dispensing systems is that they require the handling of either a liquid cleaning solution, or a roll containing such a cleaning solution. This exposes workers using the cleaning materials to potentially toxic liquids and fumes (VOC emissions) and the cleaning liquid itself.

Moreover, when the user refills the tub with solvent, or places a new roll in the tub by hand, there is a significant opportunity for the wipers or cleaning solution to become contaminated.

Another disadvantage of the prior systems here under discussion is that they require a substantial length of time to refill the tub, either with a new roll of material and a liquid, or with a pre-wetted roll of wiper material.

Another problem with such prior systems is that the tub is relatively bulky, difficult to handle and requires substantial storage space.

Another problem which is met in supplying pre-moistened wipers in sealed packages is that the security of the sealed package often is compromised when the more aggressive cleaning solvents such as those described above are used. Three-layer laminations of polyethylene as an inside layer, polyester as an outside layer, with aluminum foil in between have been used, but the foil layer sometimes develops cracks where the material is folded or bent. Such cracks can compromise the security of the container.

Further problems exist with certain types of resealable bags containing pre-moistened folded or flat separate wipers in a stack. The seals comprise a strip of adhesive covering a hole in one wall of the bag.

The hole in the bag often is relatively small, thus making it relatively difficult to remove the wipers from the bag.

Also, the adhesive seal often adheres to the hands or the gloves of the user, thus increasing the possibility of contamination of the wipers in the bag, slowing the use of the wipers, and, possibly reducing the adhesion provided by the adhesive.

Further, the integrity of the re-sealing of the bag depends on the integrity of the adhesive, and upon attaching it to the bag material without folds. This sometimes is difficult to do.

OBJECTS OF THE INVENTION

It is an object of the present invention to provide a product which eliminate or alleviates the foregoing problems.

In particular, it is an object to provide a dispenser and cleaning method in which the cost of using the dispenser and wipers is reduced.

It is a further object to provide wiping applicator dispensing containers which have a relatively long shelf life, even when they contain aggressive cleaning materials.

Another object of the invention is to provide a cleaning method and dispensing device which minimizes user contact with the materials, and minimizes contamination and VOC emissions into the workplace.

Additionally, an object of the invention is to provide such a dispensing device which is more compact, easier to handle and less hazardous to use than prior devices of a similar type.

It is a further object to provide a reclosable dispenser package or bag which has a relatively large opening for removing folded flat wipers, and has a closure device which does not rely on adhesives for re-closing the bag.

SUMMARY OF THE INVENTION

The foregoing objects are met, in accordance with, one aspect of the present invention, by the provision of a strip of wipers in a flexible bag with a re-closable dispensing opening in the bag. Preferably, the strip is formed into a roll, with adjacent wipers being delineated one from another by lines of weakness such as perforation lines.

The bag normally is sealed, and can be reclosed after removing a wiper from the bag.

Preferably, the strip of wipers is pulled through a restricted outlet fixture which substantially impedes the movement of the strip through the opening. This provides resistance which enables the lead wiper to be readily torn free from the remainder of the strip, and holds the remainder of the strip stationary so that it does not fall back into the bag.

Each bag is relatively inexpensive so as to be disposable after each use. Thus, the wipers can be used with a minimum of exposure to the fumes and the liquids of the solvents contained within bag. The chances for contamination of the wipers in the bag are significantly reduced, as compared with prior dispensing systems and wiping methods using such wipers.

Preferably, the roll of wipers is flattened in the package and thus takes up considerably less space than if it were in a cylindrical tub. This reduces storage space for the cleaning system, and requires the user to store only one type of package, instead of two or more. Also, this avoids the problem in which the wrong chemicals can be placed in the canisters when using a two-component system.

The very considerable time of workers which is needed to refill the prior art tubs is eliminated by providing a much cheaper package which can be disposed of after each use.

The dispensers are so relatively compact that they can be carried on the body of the workers using them, in pockets, tool aprons and the like and thus can be faster and more accessible to use.

In another aspect, the invention comprises the provision of a pre-moistened wiper bag made of a laminate material which is highly resistant to deterioration by contact with aggressive cleaning liquids. In order to better resist the more aggressive cleaning solvents, the bag preferably is made of a laminate including layers of plastic and a metal foil such as aluminum foil.

Preferably, the bag material consists of an inner layer of polyethylene, then a layer of polyester, a layer of foil and an outer layer of polyester. This maximizes the resistance to deterioration by aggressive cleaning materials.

The invention, in another aspect, comprises a bag containing one or more wipers with a slide fastener to make it reclosable. The bag has a much wider outlet opening than many prior bags using adhesive flaps, and avoids the difficulties of handling the adhesive flaps.

Preferably this bag uses the laminated wall structure described above.

The foregoing and other advantages and features of the invention will be set forth in or apparent from the following description and drawings.

IN THE DRAWINGS

GENERAL DESCRIPTION

Figures 1, 2, 3:
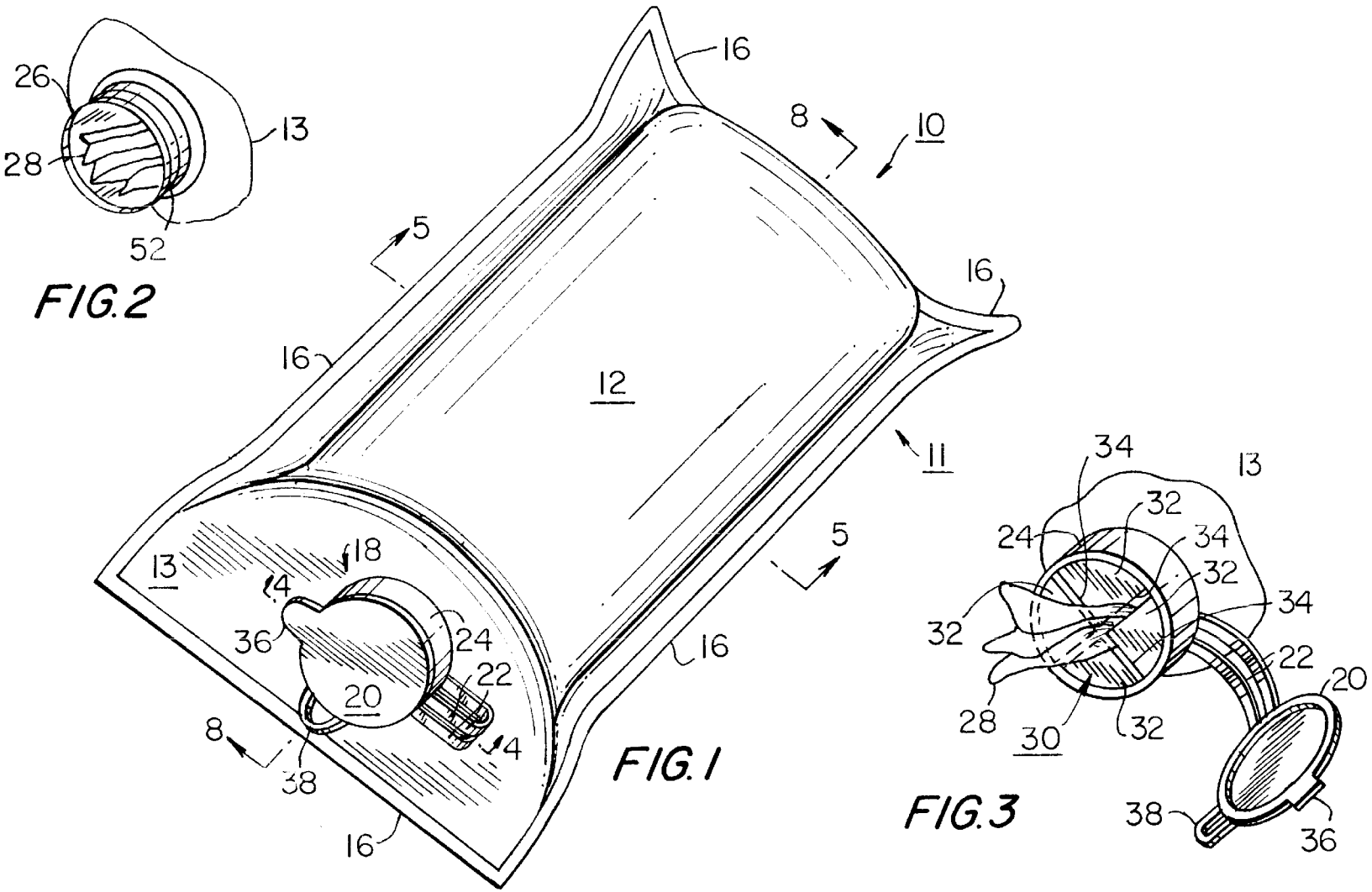
FIG. 1 is a perspective view of a wiper dispenser constructed in accordance with one aspect of the present invention.
FIGS. 2 and 3 are perspective views of a portions of the dispenser shown in FIG. 1, with the remainder of the dispenser broken away.

FIG. 1 is a perspective view of a dispensing package 10 constructed in accordance with the present invention. The package 10 comprises a bag having a front wall 12 and a rear wall 14 (see FIGS. 5 and 8) which are sealed together at their edges 16 to form a sealed bag.

Figure 5:
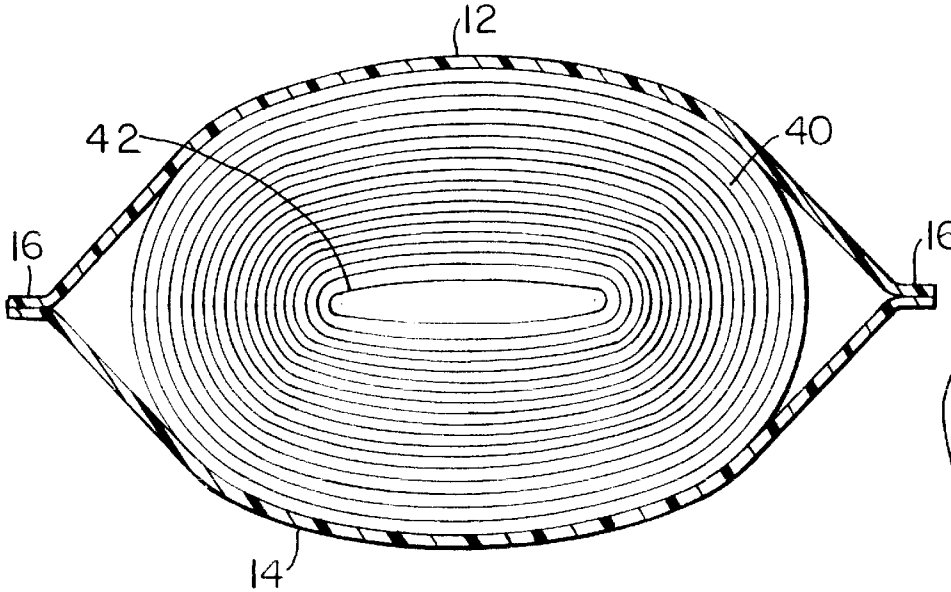
FIG. 5 is cross-sectional view taken along line 5—5 of FIG. 1.
Figure 8:
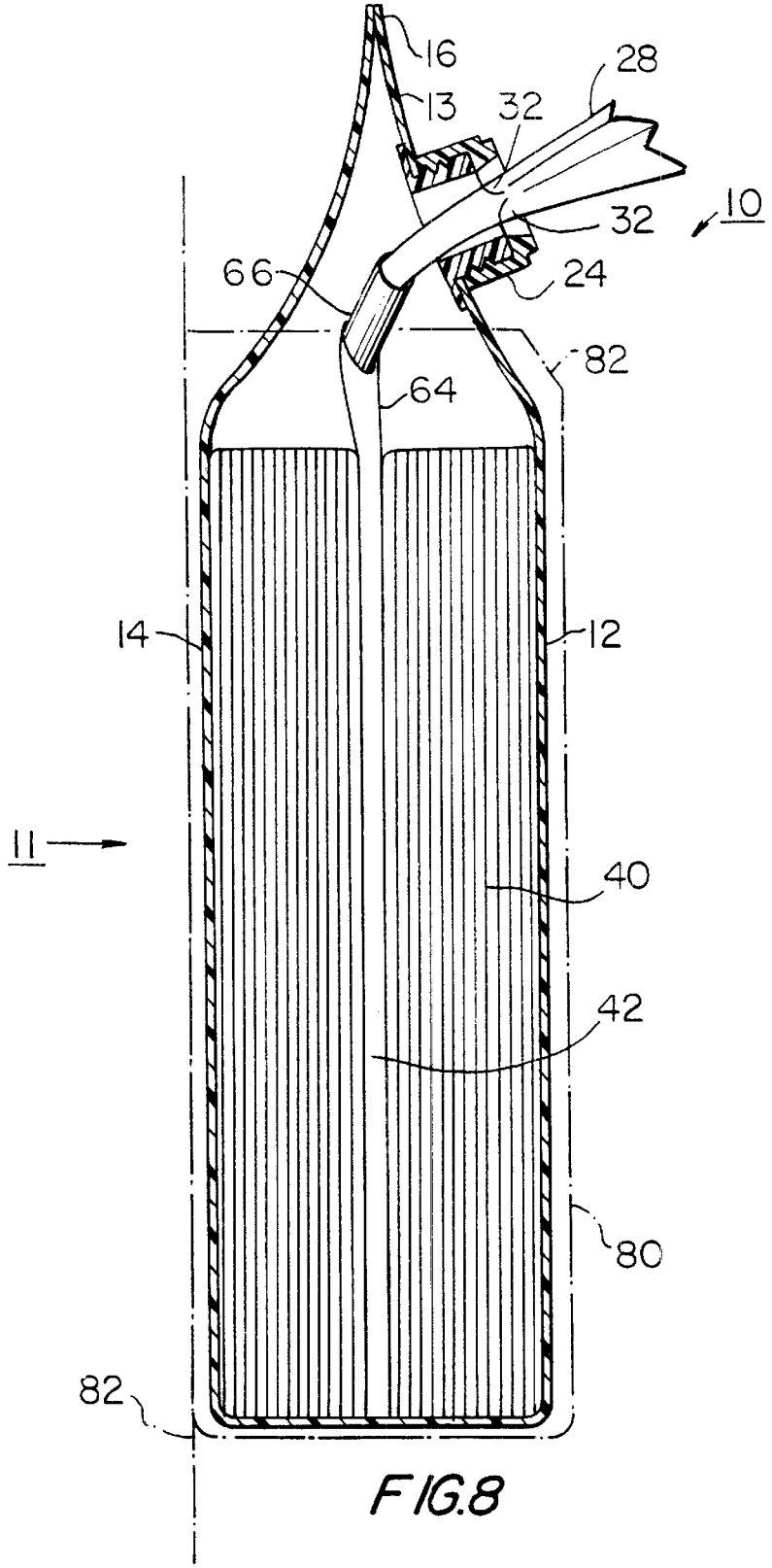
FIG. 8 is a cross-sectional view taken along line 8—8 of FIG. 1, with the cover over the dispensing outlet removed.

As it is shown most clearly in FIGS. 5 and 8, the bag has a lower portion 11 and an upper portion 13. The lower portion 11 of the bag contains a strip of wiper material forming a flattened roll 40. The portion 13 extends beyond the portion 11 where the roll 40 is located so as to provide room for a dispensing outlet fixture 18 (FIG. 1).

The outlet fixture 18 (FIG. 1) includes a cylindrical cap base member 24 (also see FIGS. 3 and 4) with a snap-on cap 20 attached to the cylindrical structure 24 by a pair of elongated plastic flexures 22.

The cap base 24 has four pie-shaped flexible plastic tabs 32 which project radially inwardly on the inside of the base 24, with slots 34 separating the projections 32 from one another. Five tabs 32 forming a "star" pattern also can be used. The projections 32 form a restrictive outlet opening structure 30 which impedes the movement of wiper material, such as the wiper 28, when it is pulled outwardly through the outlet opening. The projections 32 bend and flex (as shown in FIG. 8) so as to allow the material to be pulled through the outlet opening with a certain degree of impedance. This allows the wiper material to be pulled out until the leading wiper is torn away from the succeeding portions of the wiper strip.

The structure 24 has internal threads and is screwed onto an outlet spout 26 (see FIGS. 2 and 4) which has external threads 52. The cap base structure 24 can be removed from the spout 26 by unscrewing it to gain access to the interior of the bag.

Opening the Bag

Figure 4:
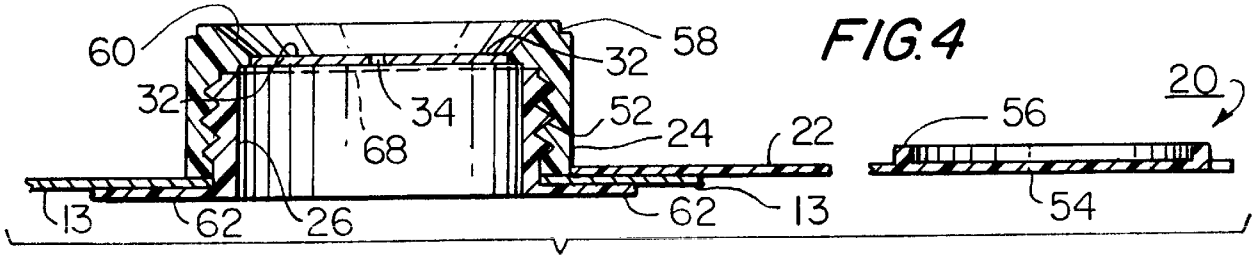
FIG. 4 is a cross-sectional view taken along line 4—4 of FIG. 1.

When the package 10 (shown in FIG. 1) is shipped from the manufacturer, the outlet opening preferably is sealed by means of a foil covering 68, shown in dashed lines in FIG. 4, over the end of the outlet spout 26 to keep the package securely sealed until ready for use.

As it is shown in FIG. 2, when the dispenser is to be used, the cap base structure 24 is screwed off the spout 26 to expose the interior of the package through the outlet opening. The leading edge of the wiper strip is shown at 28 in FIG. 2. The user grasps the end 28 of the strip, pushes it through the outlet flaps 32 in the base structure 24, and screws the cap structure 24 back on to the spout 26.

As it is shown in FIG. 3, with the cap 20 removed, the end 28 of the wiper strip extends from the outlet opening. The end 28 can be pulled by the user outwardly until the first perforation is reached, at which point the friction of the wiper rubbing against the flaps 32 usually is sufficient to cause the first wiper to tear lose from the subsequent wipers. The user can give the wiper a little harder tug to tear if off, if necessary. Then, the protruding end of the next wiper sheet is pushed back into the spout, if necessary, the lid 20 is snapped shut and the wiper is used.

As it is shown in FIGS. 5 and 8, the roll 40 has a hollow core 42 which is considerably flattened from its normal cylindrical shape. Nonetheless, the roll still issues successive coils of wiper material 64 and 66 (FIG. 8) from the central hole 42, as the outer end 28 of the wiper strip is pulled past the flaps 32.

Outlet Fixture Structure

Referring to FIG. 4 as well as FIGS. 1–3 and 8, the outlet opening fixture 18 is well known. The cap base 24 has a beveled outlet edge at 60, and the flaps 32 are molded integrally into the cap base structure. The flexures 22 and the cap 20 also are molded integrally with the cap base. The cap 20 includes a cover portion 54 with a snap ridge 56 which mates with a groove 58 around the upper outer edge of the base 24 to snap the cover on to and off of the cap base.

The spout structure 26 includes a bottom flange 62 extending outwardly which is bonded to the edges of a circular hole cut in the material 13 of the top portion of the bag. The material of the outlet fixture 18 preferably is polyethylene. The inner surface of the bag material also is polyethylene so that the bag and outlet fixture are easily thermally bonded together.

Wiper Material

Figure 7:
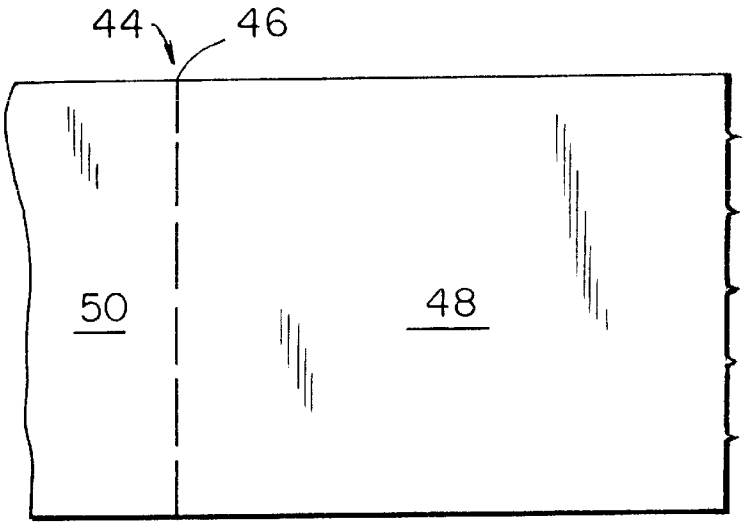
FIG. 7 is a top plan view of a portion of perforated strip of wiper material stored in the dispenser shown in FIG. 1.

As noted above, the wiper material is formed into an elongated strip, a portion of which is shown in FIG. 7. The strip includes a substantial number of individual sheets 48 and 50, usually approximately 100 per roll. The sheets are delineated from one another by perforation lines 46 which are designed so that the material is strong enough to allow it to be pulled out of the opening, but weak enough so that, with a slightly greater pull, the end can be torn lose from the remainder of the strip.

The material of which the strip is made depends upon the use to which the wipers are to be put. For uses in which extremely particle-free wipers are not required, such as in cleaning automobiles, airplanes and other vehicles prior to painting, or at other times, a highly suitable material is a hydroentangled mixture of synthetic fibers and cellulose fibers such as that sold under the trademark "TechniCloth" by the Texwipe Company.

Other usable materials include those which are absorbent, do not fall apart easily when moistened, are resistant to the solvents absorbed into them and are sufficiently inexpensive for the use. The materials also should be capable of using perforations to facilitate tearing.

Cleaning Liquid

Preferably, the wipers in the roll 40 are pre-moistened when packaged at the factory. This is done by encasing the roll in the bag, and pouring a pre-measured quantity of cleaning liquid into the bag before sealing it with the seal 68. Preferably, the end 28 of the first wiper is pulled outwardly from the center core to a position where it is adjacent the outlet spout 26 so that it can be easily grasped by a user.

The cleaning liquid can be any of a wide variety of liquids used for cleaning purposes, including water, isopropyl alcohol, etc.

For many applications, such as for cleaning the surfaces of aircraft and automobiles before painting, it is preferred to use more aggressive cleaning solvents such as acetone, MPK, MEK or mixtures of those substances together with naphtha and other aromatic hydrocarbons. Such aggressive solvents often are deleterious to the materials of which typical prior art wiper tubs are made.

The quantity of cleaning liquid absorbed into the wiper material varies depending upon the use to which it is to be put. Thus, the quantity can be anywhere from enough to moisten the entire roll, which is approximately 20 to 25 percent of saturation ("wetted"), up to or exceeding absorbive capacity ("saturation").

In some uses to which the wipers may be put, the cleaning substance will comprise or contain a biocide to be used in killing germs. Such wipers often are used in pharmaceutical manufacturing to clean and sterilize working surfaces. Therefore, the term "cleaning liquid" as used herein includes biocides or mixtures of biocides with other liquids.

Bag Material

In accordance with one aspect of the present invention, the material of which the bag containing the wiper roll is made, consists of a laminate including at least one layer of metal foil, preferably aluminum foil, to serve as a vapor barrier, and a plurality of plastic layers.

Figure 6:
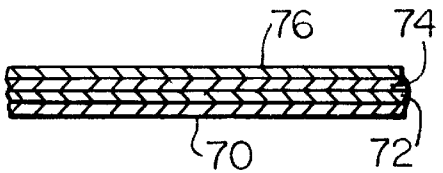
FIG. 6 is an enlarged cross-sectional view of the material of which the bag shown in FIG. 1 is made.

As it is shown in FIG. 6, which is an enlarged cross-sectional view of the bag material, an inner layer 70 of polyethylene of 0.0002" thickness is provided. Secured to this is a layer 72 of polyester, then the layer 74 of aluminum foil, and an outer layer 76 of polyester. The aluminum layer is 0.00035" thick, and the polyester layers are 0.00048" in thickness. Each layer is secured to the succeeding layer using permanent adhesives resistant to solvent attack.

The laminate differs from prior laminates for similar bags primarily in the addition of the inner layer 72 of polyester between the polyethylene layer and the foil layer.

The applicant has recognized that the polyethylene is brittle and tends to crack under normal handling and that such cracks also tend to cause the metal foil to tear. The polyester layer is more flexible and minimizes the tearing of the foil.

The laminate is know for use in bags for iodine solution used in hospitals, etc., but is not believed to be known for use in wiper bags.

The laminate also is strong and tough enough to resist tearing when a wiper is being pulled out of the bag.

Portability

FIG. 8 illustrates the compactness and portability of the dispenser 10. Because the roll 40 has been flattened to a high degree, the entire package is less bulky to carry then if the roll were cylindrical. Thus, the package can be inserted into a large pocket 80 in the work clothing 82 of a worker so that it can be carried with the worker and will be very handy. The pocket 80 preferably has an upper edge which is restricted as by means of a button flap so as to hold the bag down against an upwardly and outwardly pull on the wiper material 28.

The pocket 80 also can represent a tool pouch or shop apron worn around a worker's waist, or a receptacle for holding the dispenser 10 at a workstation.

Although the preferred form of the bag shown in FIGS. 1–8 is one formed by two sheets, heat-sealed together at the edges, it should be understood that other bag constructions can be used instead, if desired. For example, a bag also can be made out of tubular material which is cut off and heat-sealed at both ends to form a closed bag. Other bag structures can be used as well.

Zip-pack

Figure 9:
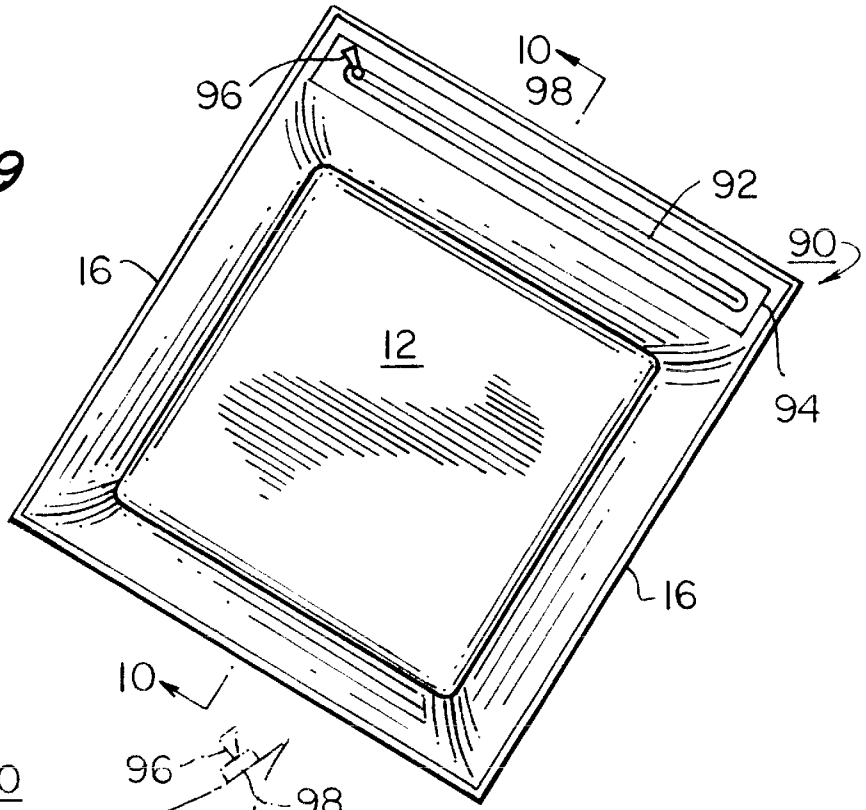
FIG. 9 is a perspective view of another wiper dispensing bag of the present invention.
Figure 10:
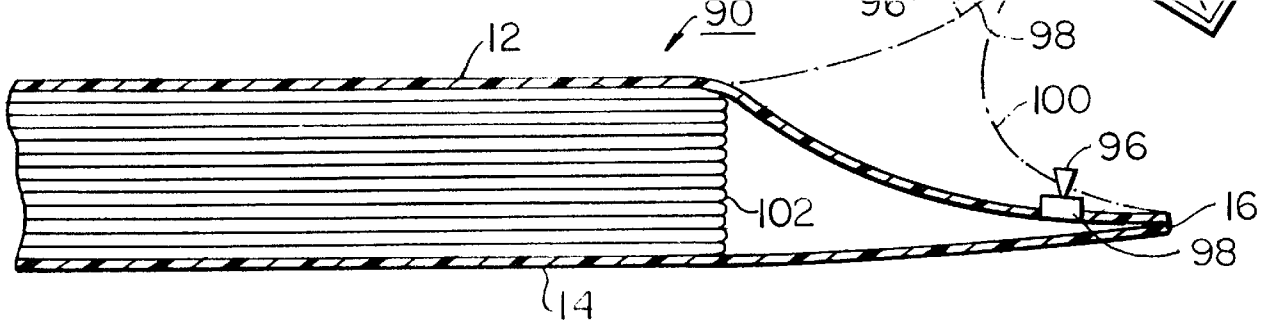
FIG. 10 is a cross-sectional and schematic view taken along line 10—10 of FIG. 9.

FIGS. 9 and 10 shown an alternative embodiment of the invention which is shown in use for housing and dispensing separate individual wipers, as opposed to those in a strip formed into a roll. The bag 90 has a front wall 12 and a rear wall 14 (FIG. 10) secured together along a border 16 around the entire package.

Rather than a circular hole into which a dispenser fixture is secured, as in the embodiment shown in FIGS. 1–8, the bag 90 has a wide opening formed along the majority of one side of the bag, which is closed by a plastic or metal slide fastener 92. The slide fastener is conventional, comprising elongated continuous flexible polyethylene grippers 98 heat sealed to the edges of the bag opening as shown in FIG. 10, and a slide fastener 96 which forces the grippers together or separates them, depending upon which direction it is moved.

A disposable label using pressure sensitive adhesive (PSA) 94 covers the zipper structure for shipping and storage until ready for use.

As is it shown in FIG. 10, which is a cross-sectional view of a portion of the bag 90, the bag contains a plurality of separate wipers 102, stacked one on top of the other. The wipers can be made of any of a variety of woven, knitted or hydroentangled natural or synthetic fibers. They can be folded or unfolded. For example, in automobile manufacturing, it is desired to have quarter-folded wipers; that is, wipers which are folded once and then folded a second time. However, in clean room applications, it usually is preferred to have wipers which are folded differently, either with the edges folded over once and again upon themselves, as with facial tissues, or simply flat and unfolded.

The wipers 102 are pre-moistened with pre-determined quantities of liquid cleaning solutions as with the wipers described above and stored in roll form.

When the user desires to remove a wiper from the bag 90 for use, the disposable label 94 is removed and discarded, and the zipper pull 96 is moved from its closed position to the opposite end, the upper edge of the top wall 12 is lifted up, as shown in dashed lines 100 in FIG. 10, and the user can easily withdraw one or more of the wipers from the package. Then, when finished, the user can slide the slider 96 to its initial position to reclose the package.

The zipper type package shown in FIGS. 9 and 10 is easier to use and more certainly re-closable than prior similar bags using an adhesive strip as a closure over a hole. This type of package also is better than zip-lock closures where two strips of polyethylene snap together to form a liquid seal.

The opening through which wipers can be withdrawn is much larger and easier to use. The zipper uses no adhesives which can stick to the hands and gloves of the user. In addition, it is not necessary to make certain that the surfaces onto which the prior adhesive strip is attached are smooth so as not to leave any gaps in the closure of the package. Thus, it is easier to securely close the bag.

In addition, the slider 96 can be easier to operate, especially if the user is wearing gloves, than an adhesive strip, which might require one to push his or her fingernails underneath the edge of the strip to lift it, thus requiring the removal of gloves.

Preferably, the material of which the walls of the bag 90 are made is the same as that for the bag shown in FIGS. 1–8, thus making the bag more versatile and usable with a wide variety of both aggressive and milder cleaning solutions.

It is to be understood that the foregoing description of the preferred embodiments of the invention is provided by way of example of the numerous different forms the invention can take. Therefore, without naming numerous specific alternatives, it should be understood that the claims are intended to cover not only the invention as specifically described above in its preferred embodiment, but also numerous equivalent structures which those skilled in the art can use to practice the invention without departing from the teachings contained herein.

What is claimed is:

1. An industrial cleaning device comprising a sheet material dispenser bag having at least one flexible side-wall, said side-wall comprising at least two layers, one made of metal and the other made of a flexible plastic material, said flexible plastic material forming the outside of said side wall, a strip of industrial cleaning sheets delineated from one another by lines of weakness, said strip being contained within said bag, and an industrial cleaning liquid absorbed into said sheets, said bag having an outlet fixture forming a restricted outlet opening through which said sheet material can be pulled with substantial resistance so as to allow a sheet extending through said outlet opening to be withdrawn and torn free from said strip when pulled out through said outlet opening, in which said strip is formed into a roll and said roll is flattened and has a hollow core hole from which said sheet material can be withdrawn longitudinally, said hole being aligned so as to exit towards said outlet opening, said industrial cleaning liquid containing a solvent selected from the group consisting of acetone, isopropyl alcohol, methyl propyl keytone and methyl ethyl keytone, naphtha, aromatic hydrocarbons and a mixture of two or more of the foregoing.

2. A device as in claim 1 in which said bag has a reclosable snap-on cover for said outlet opening.

3. A device as in claim 1 in which said bag includes an extension which extends substantially beyond said roll in one direction, said outlet fixture being located within said extension.

4. An industrial cleaning sheet dispenser comprising a bag with at least one flexible side-wall, said side-wall comprising at least three layers, one made of metal and the other two made of a flexible plastic material, said flexible plastic material forming the outside and inside layers of said side-wall, a roll of elongated industrial cleaning sheet material with sheets delineated from one another by lines of weakness, said roll being sealed within said bag, a reclosable restricted dispensing opening in said side-wall, and a removable cap on said dispensing opening, in which said sheet material has a quantity of industrial cleaning liquid absorbed in it, the materials of which said bag is made being substantially impervious to said cleaning liquid, said industrial cleaning liquid containing a solvent selected from the group consisting of acetone, isopropyl alcohol, methyl propyl keytone and methyl ethyl keytone, naphtha, aromatic hydrocarbons and a mixture of two or more of the foregoing.

5. A dispenser as in claim 4 said reclosable restricted dispensing opening including a plurality of flexible flaps extending into said opening to partially occlude the passage of said sheet material through said opening, said flaps being sufficiently flexible to bend aside to allow said material to pass through said opening with impedance, while holding said material against returning into said bag.

6. An industrial cleaning sheet dispenser comprising a bag with at least one flexible side-wall, a roll of elongated industrial cleaning sheet material with sheets delineated from one another by lines of weakness, said roll being sealed within said bag, a re-closable restricted dispensing opening in said side-wall, and a removable cap on said dispensing opening, in which said side-wall is a laminate of plastic and metal sheet materials, with edges heat-sealed together in which said laminate comprises an inner layer of polyethylene, a first polyester layer secured to said inner layer, a layer of aluminum foil secured to said first polyester layer, and an outer layer comprising a second layer of polyester material secured to said aluminum foil.

7. A method of cleaning a surface, said method comprising the steps of (a) providing a bag with at least one flexible side-wall, said side-wall comprising at least two layers, one made of metal and the other made of a flexible plastic material, said flexible plastic material forming the outside of said side wall, said bag containing a flattened roll of industrial wiper sheets delineated from one another by means of lines of weakness, said bag having a reclosable outlet opening; (b) pulling one end of said strip out of said bag and tearing off one of said sheets from said strip and using it for wiping said surface, said strip being pre-wetted with an industrial cleaning solvent, said cleaning solvent being selected from the group consisting of acetone, isopropyl alcohol, methyl propyl keytone and methyl ethyl keytone, naphtha, aromatic hydrocarbons and a mixture of two or more of the foregoing.

8. A method as in claim 7 including the step of securing said bag to the person of a user of said wiper sheets to facilitate their use wherever the user is located.

9. A method as in claim 7, of preparing a surface for painting, in which said wiper sheets are pre-wetted with a solvent for cleaning said surface to be painted, said bag being made of a material resistant to deterioration from contact with said solvent, and using at least one of said sheets for cleaning said surface.

10. A cleaning device comprising a flexible bag, a plurality of pre-moistened industrial cleaning applicators in said bag, said applicators containing a cleaning liquid comprising at least one solvent, the amount of said cleaning liquid in said applicators being in the range from an amount at least sufficient to moisten each applicator in said bag to an amount sufficient to exceed saturation of said applicators, said bag having at least one wall comprising a laminate having an inside layer of polyethylene film, a layer of polyester film, a layer of metal film, and an outside layer of polyester film.

11. A device as in claim 10 which said metal film is aluminum.

12. A device as in claim 10 in which said cleaning liquid contains a solvent selected from the group consisting of methyl ethyl ketone, methyl propyl keytone, naphtha, aromatic hydrocarbons, and a mixture of two or more of the foregoing.

13. A device as in claim 10 including a plurality of said applicators in the form of a strip with individual applicators being delineated from one another by lines of weakness, and an outlet fixture for said bag, said outlet fixture having an outlet opening and said means for holding and impeding the movement of said strip through said bag, and a replaceable cover.

14. A device as in claim 13 in which said strip is formed into a roll with a hollow center, the strip being fed out from said hollow center through said outlet fixture.

15. A device as in claim 13 in which said bag has a reclosable opening with a slide fastener to close and open said opening.

16. A cleaning device comprising a plastic bag having at least one side-wall, said side-wall comprising at least three layers, one made of metal and the other two made of a flexible plastic materials, said flexible plastic material forming the outside and inside of said side wall, a plurality of industrial cleaning wipers contained in said bag, said wipers being absorbent and having a cleaning liquid absorbed in them, said bag having an elongated opening and a slide fastener for closing said opening, said slide fastener being made of plastic strips sealed to the bag material at the edges of said opening, and a slider, the amount of said liquid being from an amount sufficient to moisten all of said wipers to an amount exceeding that needed to saturate all of said wipers, in which said liquid is selected from the group consisting of isopropyl alcohol, MPK, MEK, acetone, naphtha, aromatic hydrocarbons, said plastic materials being resistant to deterioration due to contact with said solvents.

17. A cleaning device comprising a plastic bag with a plurality of industrial cleaning wipers therein, said wipers being absorbent and having a cleaning liquid absorbed in them, said bag having an elongated opening and a slide fastener for closing said opening, said slide fastener being made of plastic strips sealed to the bag material at the edges of said opening, and a slider, the amount of said liquid being from an amount sufficient to moisten all of said wipers to an amount exceeding that needed to saturate all of said wipers in which said bag has at least one wall consisting of a laminate of aluminum film sandwiched between two layers of polyester, with a layer of polyethylene on one of the polyester layers.

18.A device as in claim 17, in which said applicators are made of a hydroentangled mixture of synthetic fibers and cellulose fibers.

* * * * *